US006478178B2

(12) United States Patent
Montgomery

(10) Patent No.: US 6,478,178 B2
(45) Date of Patent: Nov. 12, 2002

(54) FERMENTATION LOCK FOR WINE BARREL

(76) Inventor: Donald C. Montgomery, 1250 Enos Ave., Sebastopol, CA (US) 95472

( * ) Notice: Subject to any disclaimer, the term of this patent is extended or adjusted under 35 U.S.C. 154(b) by 14 days.

(21) Appl. No.: 09/802,800

(22) Filed: Mar. 8, 2001

(65) Prior Publication Data

US 2002/0125248 A1 Sep. 12, 2002

(51) Int. Cl.[7] ..... B65D 51/16

(52) U.S. Cl. ..... 220/203.13; 220/203.27; 220/203.29; 217/100; 215/311; 215/364

(58) Field of Search ..... 220/203.11, 203.13, 220/203.27, 203.29, 231, 89.1, 367.1, 373, 203.19, 203.2, 203.23; 137/854, 852; 215/270, 271, 260, 262, 307, 311, 364, 355, 358, 361; 217/98–101, 78–79, 108–109

(56) References Cited

U.S. PATENT DOCUMENTS

| | | | | | |
|---|---|---|---|---|---|
| 409,713 | A | * | 8/1889 | Sunday | 217/100 |
| 1,653,818 | A | * | 12/1927 | Nagel | 217/100 |
| 1,734,361 | A | * | 11/1929 | Bloom | 217/100 |
| 2,950,835 | A | * | 8/1960 | Alvear | 217/98 |
| 3,805,990 | A | * | 4/1974 | Palaudarias | 220/231 |
| 4,826,029 | A | * | 5/1989 | Skoglie | 215/355 |
| 5,702,018 | A | * | 12/1997 | Montgomery | 217/100 |
| 6,183,982 | B1 | * | 2/2001 | Nastasia | 215/270 |

* cited by examiner

*Primary Examiner*—Nathan J. Newhouse
(74) *Attorney, Agent, or Firm*—Larry D. Johnson; Craig M. Stainbrook; Johnson & Stainbrook, LLP

(57) ABSTRACT

An improved stopper apparatus for use with wine barrel bung holes includes a generally frusto-conical stopper member having a central aperture, a top surface, a bottom surface, and an outer circumferential surface adapted to seal against the inner circumferential surface of the bung hole. The apparatus further includes a sealing insert member having a top portion, a middle portion, and a bottom portion, the top portion having a diameter slightly greater than the stopper member central aperture such that the sealing insert member can be pushed into the central aperture so as to bring the top surface of the sealing insert member with the top surface and the stopper member during barrel aging. The sealing insert member further has a lower surface adapted for sealing engagement against the stopper member top surface during barrel fermentation. The bottom portion includes at least one flexible lateral projection element adapted to contact and apply a force against the stopper member bottom surface, so as to urge the top portion lower surface into sealing engagement with the stopper member top surface.

10 Claims, 4 Drawing Sheets

FERMENTATION LOCK FOR WINE BARREL

BACKGROUND OF THE INVENTION

1. Field of the Invention

This invention relates generally to stoppers and seals used for access and vent holes in a container, and more specifically to an improved stopper apparatus for use with wine barrels and the like, providing a positive seal fermentation lock for the barrel.

2. Description of the Prior Art

Wine barrels and related containers typically include a bung hole or vent hole in a side or end of the barrel, through which the barrel can be filled or emptied, and the contents of the barrel accessed for topping off, testing, sampling, treatment and the like. The bung hole is usually sealed with a frusto-conically shaped stopper member to prevent contaminants from entering the barrel, and to prevent air circulation into or out of the barrel. These stopper members are often made from wood, rubber, silicone, or like material, and are well known and in widespread use. Carbon dioxide and/or other gasses may be produced as a byproduct of the wine fermentation process. These gasses may accumulate in the barrel until the gas pressure exceeds the sealing pressure provided by the stopper, at which time the stopper is displaced and the gas escapes. Often, displacement of the stopper is a minor matter and of little consequence, such that the stopper continues to provide a zero-pressure seal. However, on other occasions the displacement may be significant, resulting in a complete loss of sealing.

A solution to this problem is disclosed in U.S. Pat. No. 5,702,018, to Montgomery (the instant inventor), which teaches a positive seal fermentation stopper apparatus for wine barrels or vent holes in any vessel. The disclosed apparatus includes a generally frusto-conical stopper member having a top surface, a bottom surface, and an outer circumferential surface which is adapted to seal against the inner circumferential surface of a barrel's bung (vent) hole, all in the traditional manner. The stopper member includes a central aperture having a length and a diameter, preferably along the longitudinal axis of the stopper member. The apparatus further includes a sealing insert member having a top portion, a middle portion, and a bottom portion, with the top portion having a diameter greater than the stopper member central aperture, and which has a lower surface adapted for sealing engagement against the stopper member top surface. In the preferred embodiment, the top portion lower sealing surface is conical in shape to provide an efficient sealing geometry with the stopper member (preferably flat) top surface. The sealing insert member middle portion has a length generally equal to the stopper member central aperture, and a diameter less than the stopper member central aperture, and is thus adapted for passage therethrough. The sealing insert member terminates in a bottom portion which includes at least one, and preferably two or more preferably opposed flexible lateral projection elements adapted to contact and apply a force against the stopper member bottom surface, so as to urge the top portion lower surface into sealing engagement with the stopper member top surface.

This arrangement thus seals the bung hole or vent hole to provide a positive seal against air or any other matter entering the barrel. When gases form inside the vessel or wine barrel, the resultant pressure will exert a force against the insert member top portion lower sealing surface, and flex the lateral projection elements, breaking the seal formed between the insert member top portion lower sealing surface and the stopper member top surface, thus allowing the gas to escape. The amount of pressure required to operate this one-way valve can be adjusted by appropriate selection of the size and position of the lateral projection elements, or by changing the properties of the materials used.

Although the stopper apparatus of the '018 patent provides a solution to the problem of maintaining an air tight seal while simultaneously allowing trapped gases to escape from a fermentation vessel, it must still be replaced when the fermentation process is complete and barrel aging is commenced. This requires the purchase and use of a second set of stoppers, at considerable expense. Additionally, the removal of the positive seal fermentation lock exposes the liquid contents inside the barrel to atmospheric mircoorganisms and other contaminants, which, while incidental in degree may nonetheless imperil the quality of the production.

Accordingly, it would be desirable to provide a stopper apparatus which could function as both a gas-releasing positive seal fermentation lock and a permanent barrel bung for use during barrel aging or storage.

SUMMARY OF THE INVENTION

The positive seal fermentation lock for wine barrels of the present invention provides an improvement over the stopper apparatus disclosed and taught in the '018 patent. As with the stopper apparatus disclosed in the '018 patent, the fermentation lock of the present invention comprises a generally frusto-conical stopper member having a top surface, a bottom surface, and an outer circumferential surface which is adapted to seal against the inner circumferential surface of a barrel's bung (vent) hole, all in the traditional manner. Furthermore, the stopper member includes a central aperture having a length and a diameter, preferably along the longitudinal axis of the stopper member.

The apparatus also includes a sealing insert member having a top portion, a middle portion, and a bottom portion, and it is preferably fabricated from a deformable material, such as neoprene rubber, natural rubber, silicone rubber, nitrile rubber, EPDM rubber, urethane rubber, and any thermosets or thermoplastic elastomers. However, whereas the top portion of the insert member as described and taught in the '018 patent is substantially larger than the diameter of the central aperture of the stopper member, the deformable and compressible top portion of the improved apparatus of the present invention has a diameter only slightly greater than the stopper member central aperture, and thus may be pushed into the central aperture so that the top surface of the sealing insert member is flush with the top surface of the stopper member. The sealing insert member further has a lower surface adapted for sealing engagement against the stopper member top surface. In each of the preferred embodiments, the top portion lower sealing surface is conical in shape to provide an efficient sealing geometry with the stopper member (preferably flat) top surface. In a first preferred embodiment, the sealing insert member middle portion has a length generally equal to the stopper member central aperture, and a diameter less than the stopper member central aperture, and is thus adapted for passage therethrough. The sealing insert member terminates in a bottom portion which includes at least one, and preferably two or more preferably opposed flexible lateral projection elements adapted to contact and apply a force against the stopper member bottom surface, so as to urge the top portion lower surface into sealing engagement with the stopper member top surface. In a second preferred embodiment of the improved stopper apparatus, the central portion of the bottom surface of the stopper member includes a cylindrical recess (circular in cross section) and has a recessed depth sufficient to accommodate the flexible lateral projection elements. In this instance, the central aperture of the stopper member terminates at its lower end in the recess so that the middle portion of the sealing member insert member is of a shorter length than in the first preferred embodiment.

The stopper apparatus of the present invention seals a bung or vent hole to provide a positive seal against air or any other matter entering the barrel. When gases form inside the vessel or wine barrel, the resultant pressure will exert a force against the insert member top portion lower sealing surface, and flex the lateral projection elements, breaking the seal formed between the insert member top portion lower sealing surface and the stopper member top surface, thus allowing the gas to escape. The amount of pressure required to operate this one-way valve can be adjusted by appropriate selection of the size and position of the lateral projection elements, or by altering the properties of the materials used.

When gas production from within the barrel is complete and/or when barrel aging or storage is commenced, the sealing insert member may simply be pushed down into the central aperture of the stopper member so that the top surface of the insert member is flush with the top surface of the stopper member, at which time (while inserted in a barrel bung hole) it will be virtually indistinguishable in appearance from a conventional bung.

BRIEF DESCRIPTION OF THE DRAWINGS

Referring now to the drawings wherein like reference numerals refer to like components in the various views.

DETAILED DESCRIPTION OF A PREFERRED EMBODIMENT

Figure 1:
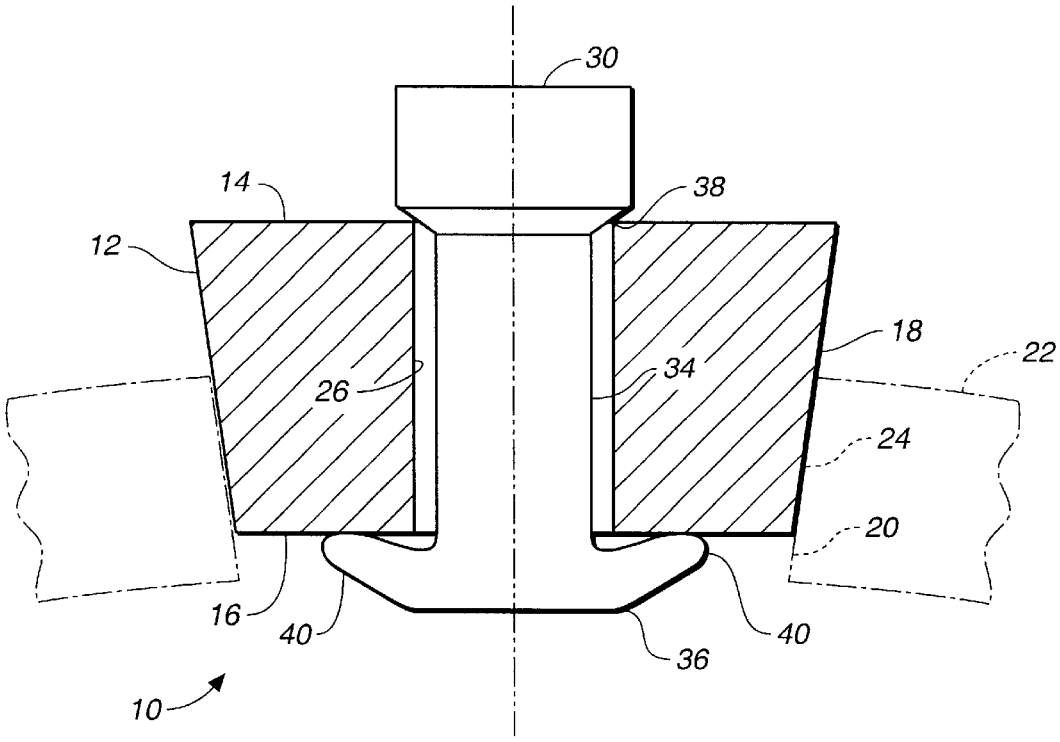
FIG. 1 is a side elevation cross-sectional view of a positive seal fermentation lock for wine barrels of this invention, illustrating a generally frusto-conical stopper member having a top surface, a bottom surface, and an outer circumferential surface adapted to seal against the inner circumferential surface of a wine barrel's bung hole, the stopper member including a central aperture; and a sealing insert member having a top portion, a middle portion, and a bottom portion, the top portion having a lower surface adapted for sealing engagement against the stopper member top surface, the bottom portion including two opposed flexible lateral projection elements adapted to contact and apply a force against the stopper member bottom surfaces.

Referring to FIGS. 1 through 7B, wherein like reference numerals refer to like components in the various views, FIG. 1 is a side elevation cross-sectional view of a first preferred embodiment of the improved positive seal fermentation lock 10 for wine barrels of this invention, illustrating a generally frusto-conical stopper member 12 having a top surface 14, a bottom surface 16, and an outer circumferential surface 18 adapted to seal against the inner circumferential surface 20 of a wine barrel 22 bung hole 24. The stopper member may be made of neoprene rubber, natural rubber, silicone rubber, nitrile rubber, EPDM rubber, urethane rubber, and any thermosets or thermoplastic elastomers, and have approximate dimensions of 2.25 inches diameter at the top surface, 1.80 inches diameter at the bottom surface, and 1.25 inches in height. Alternatively, the stopper may be fabricated from a harder, food grade polyurethane. The stopper member includes a central aperture 26 which may be of approximately 11/16 inches in diameter. Sealing insert member 30 has a top portion 32, a middle portion 34, and a bottom portion 36. The top portion 32 has an angled lower surface 38 adapted for sealing engagement against the stopper member top surface 14. In the preferred embodiment, this lower surface 38 is frusto-conical in shape. The bottom portion 36 includes two opposed flexible lateral projection elements 40 adapted to contact and apply a force against the stopper member bottom surface 16.

Figure 2:
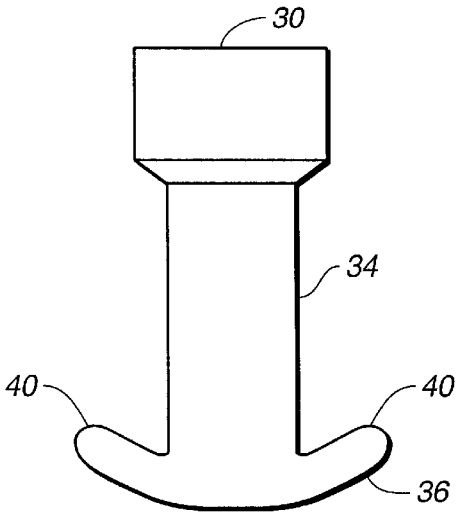
FIG. 2 is a front elevation view of the sealing insert member of FIG. 1.

FIG. 2 is a front elevation view of the sealing insert member 30 of FIG. 1. This view illustrates top portion 32, middle portion 34, and bottom portion 36, with its lateral projection elements 40. The sealing insert member 30 may be made of thirty-five "A" durometer FDA silicone rubber, or other elastomer compounds, or other suitable materials. Overall dimensions for the sealing insert member may be 1.80 inches in height, 0.80 inches in diameter at the top, 1.25 inches in width at the lateral projection elements, and 0.45 inches in diameter at the middle portion.

Figure 3:
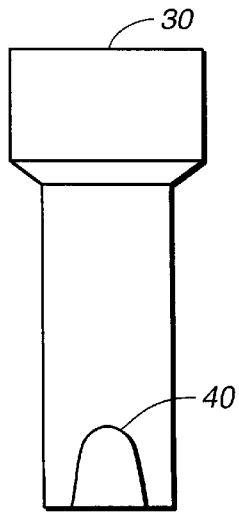
FIG. 3 is a side elevation view of the sealing insert member of FIG. 1.

FIG. 3 is a side elevation view of the sealing insert member 30 of FIG. 1. This view serves to illustrate that the lateral projection elements 40 may be generally narrower than the insert member middle portion and may be in the form of exactly one pair of opposed elements. This arrangement may be desirable to enable insertion of the insert member into the stopper member upon assembly of the apparatus, as well as removal of the insert member from the stopper member (when necessary), by forcibly bending or otherwise distorting the projection elements to enable their passage through the stopper member central aperture.

Figure 4:
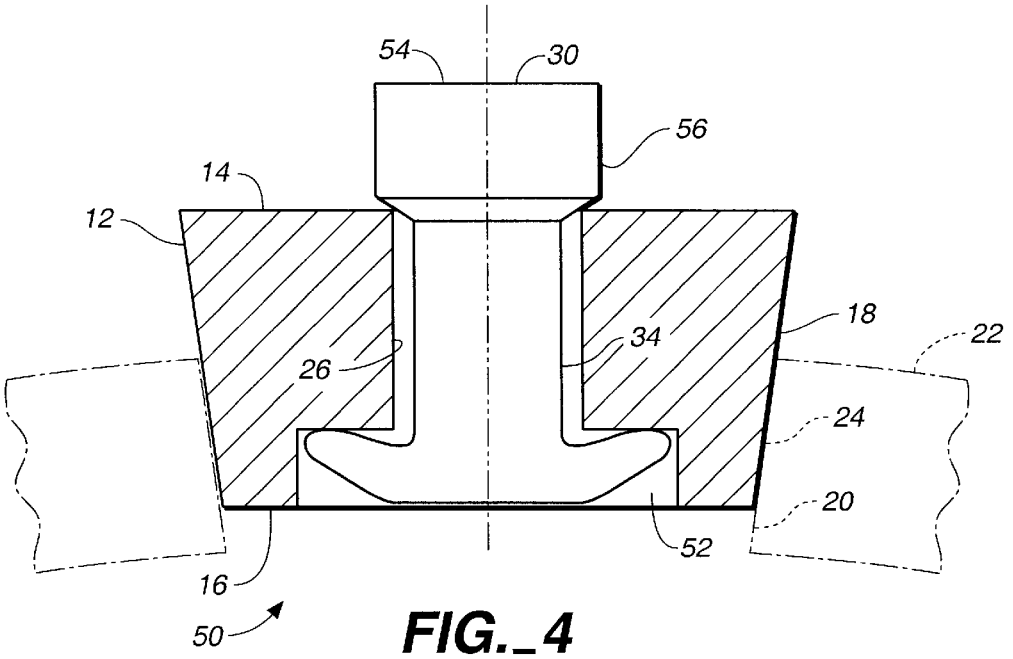
FIG. 4 is a side elevation cross-sectional view of a second preferred embodiment of the present invention, wherein the bottom surface of the stopper member includes a recess which accommodates the flexible lateral projections of the sealing insert member.

FIG. 4 is a side elevation cross-sectional view of a second preferred embodiment 50 of the present invention, wherein the bottom surface of the stopper member includes a recess 52 (shown in phantom) which fully accommodates the flexible lateral projections 40 of the sealing insert 30 member when the sealing insert member is functioning as a gas release during fermentation.

Figure 5:
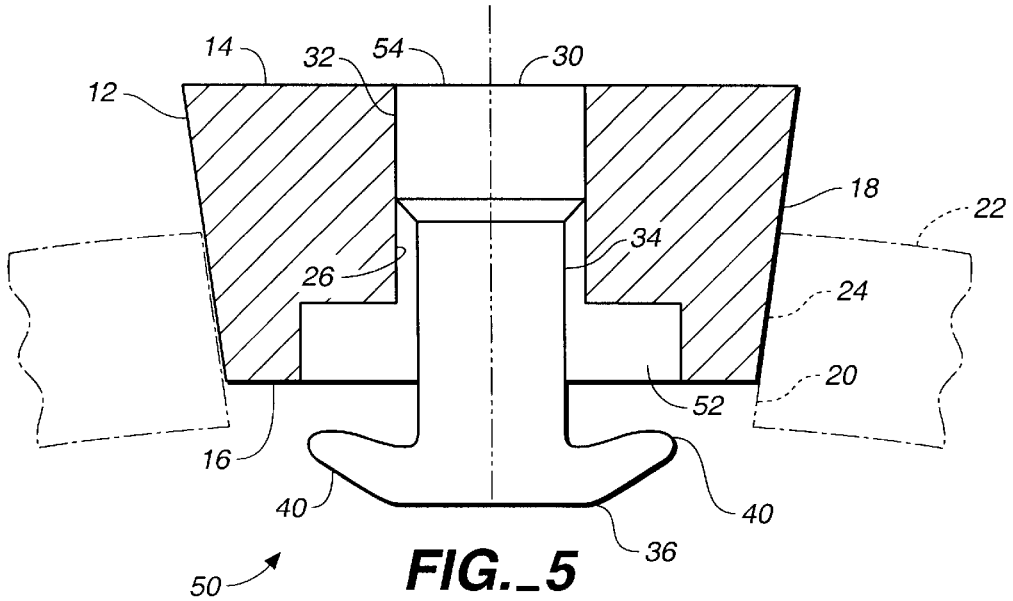
FIG. 5 is a side elevation cross-sectional view of the apparatus of FIG. 4, showing the sealing insert member pushed down into the central aperture of the stopper member so as to form a positive seal and so that the top surface of the sealing insert member is flush with the top surface of the stopper member.

FIG. 5 is a side elevation cross-sectional view of the apparatus of FIG. 4, showing that the improved stopper apparatus of the present invention includes means for creating a seal between the exterior circumferential surface 56 of the top portion 32 of the sealing insert member 30 and the central aperture 26 of the stopper member 12. As illustrated in FIG. 5, the sealing insert member may thus be pushed down into the central aperture of the stopper member so as to form a positive seal so that the top surface 54 of the sealing insert member is flush with the top surface of the stopper member. This view also shows that the central aperture 26 may taper upwardly from the recess to the top surface of the stopper member. The preferred taper is from 0.85 inches in diameter at it opening into the recess 52 (or bottom surface 16 of the stopper in the first preferred embodiment) to 0.70 inches at the top surface 14 of the stopper. This enables the user to easily remove the sealing insert member when the apparatus is removed from the barrel after use.

Accordingly, the improved stopper may also function as a conventional bung for storage and aging of wines once the fermentation process is complete. This functional characteristic is dependent upon sizing the top portion of the sealing insert member in accordance with the deformation characteristics of the materials from which both the stopper member and the sealing insert member are fabricated. The exterior circumferential diameter of the top portion of the sealing insert must be large enough to ensure a positive sealing engagement with the central aperture, but not so large that it cannot be pushed into the hole without using unreasonable force. That is, it must be sized so that the ordinary user having typical strength can push it into the aperture when the stopper is positioned in a bung hole. Thus, the preferred dimensions for deformable rubbers and plastics include the top portion of the sealing insert member having a diameter of 0.80 inches, and the central aperture of the stopper member having a diameter of 0.70 inches for at least the upper 0.25 inches, though the diameter differential is preferably between 0.05 and 0.15 inches. It will be readily appreciated that both the central aperture 26 of the stopper member and the top portion 32 of the sealing insert member may deform to create the seal.

Figure 6:
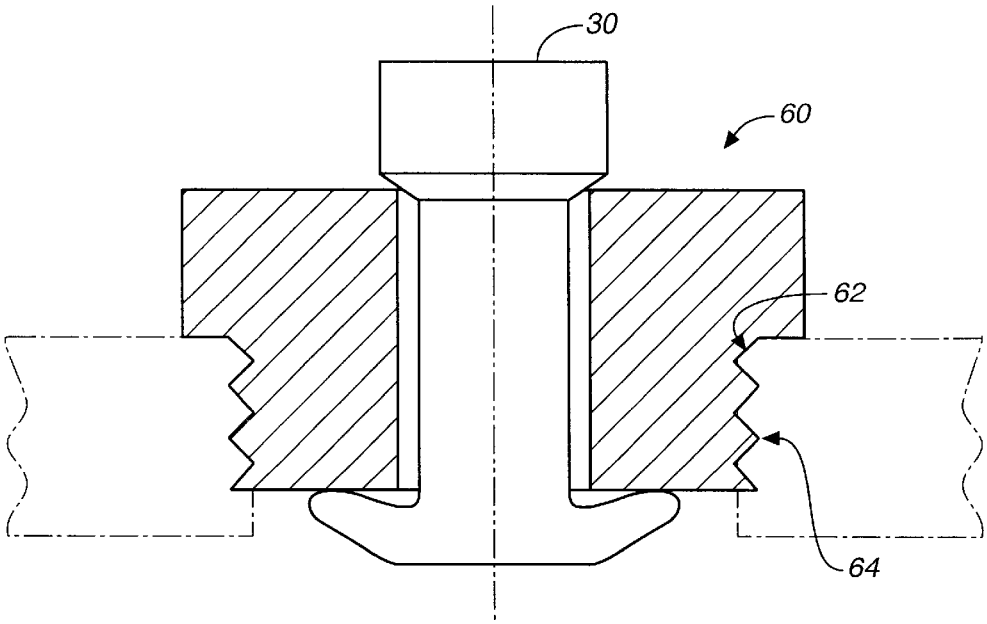
FIG. 6 is a cross-sectional side view in elevation of a second preferred embodiment of the stopper of the present invention.
Figure 6A:
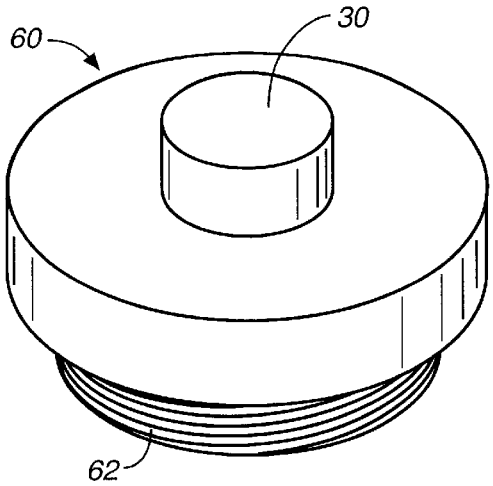
FIG. 6A is an upper perspective view of the stopper of FIG. 6.
Figure 6B:
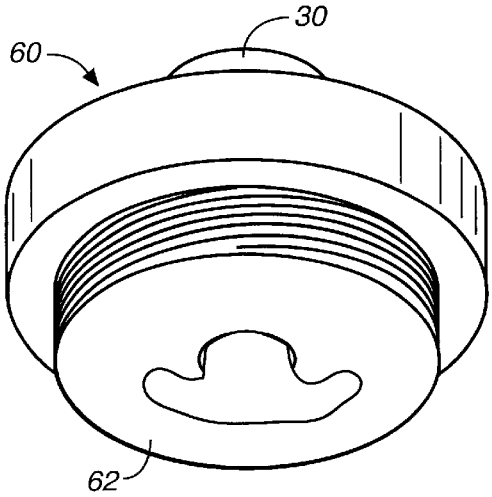
FIG. 6B is a lower perspective view of the stopper of FIGS. 6 and 6A.

FIG. 6 is a cross-sectional side view in elevation of a second preferred embodiment 60 of the stopper of the present invention, while FIGS. 6A and 6B are upper and lower perspective views thereof. These views show that the stopper may take a shape other than frusto-conical and may include a threaded lower portion 62 for threading into a complementary threaded vessel hole 64. Accordingly, the stopper need not be restricted in its application to vessels adapted for a friction fit.

Figure 7:
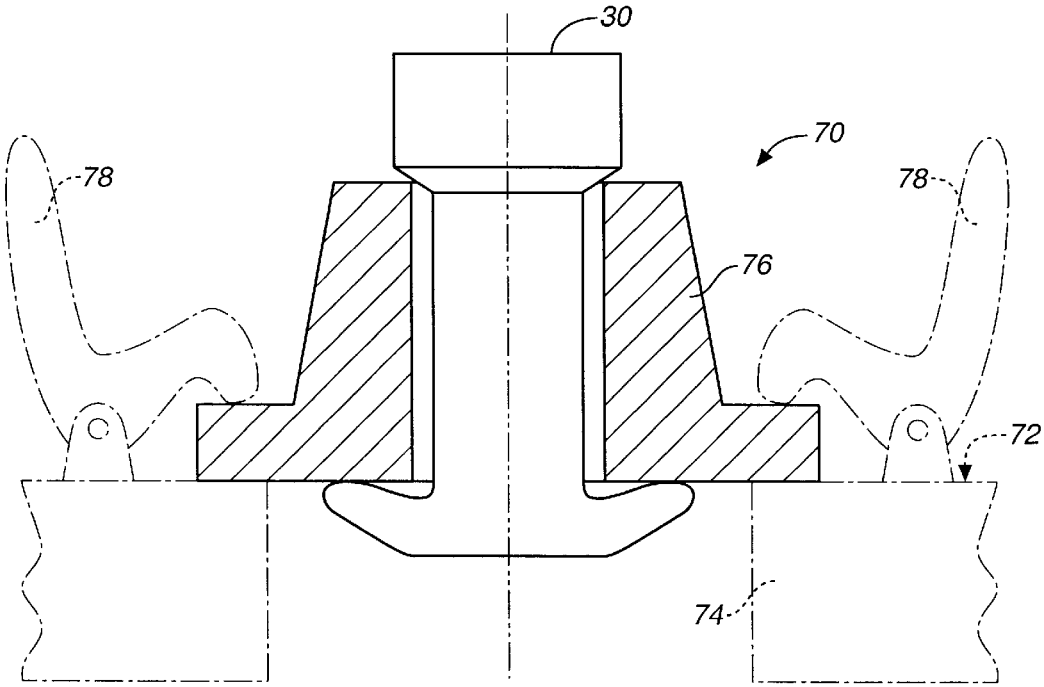
FIG. 7 is a cross-sectional side view in elevation of a third preferred embodiment of the stopper of the present invention.
Figure 7A:
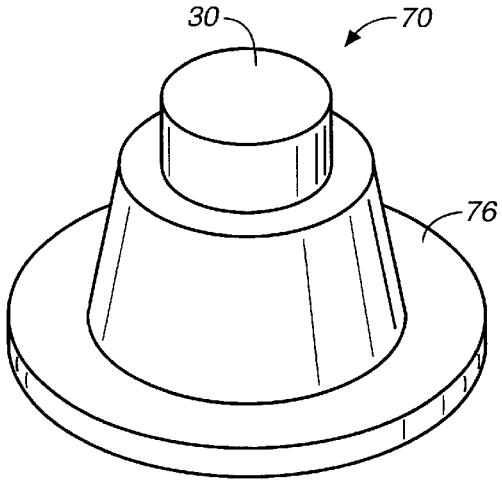
FIG. 7A is an upper perspective view of the stopper of FIG. 7.
Figure 7B:
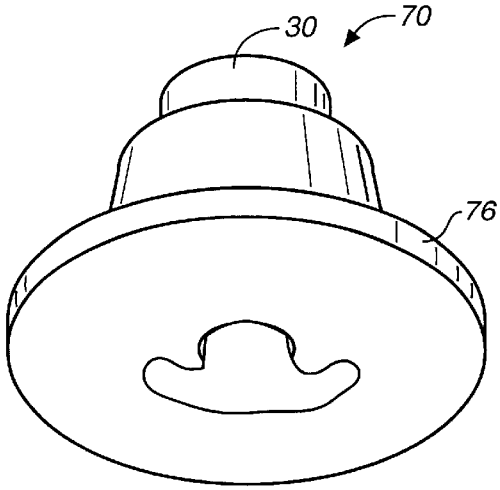
FIG. 7B is a lower perspective view of the stopper of FIGS. 7 and 7*a*.

FIG. 7 is a cross-sectional side view in elevation of a third preferred embodiment 70 of the stopper of the present invention, while FIGS. 7A and 7B are upper and lower perspective views, respectively, thereof. These views depict an embodiment suited for clamping engagement with the outer surface 72 of a vessel 74. The stopper includes a relatively thin lower rim 76 suited for securely clamping the stopper to the vessel surface by clamps 78.

It is contemplated that the second and third embodiments of the improved fermentation lock of the present invention would be fabricated of harder materials than those from which the first embodiment is fabricated, though the particular material characteristics may be adapted to the specific use to which the device will be put. In function and effect, however, the second and third embodiments duplicate the first embodiment.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims and their legal equivalents.

What is claimed as invention is:

1. An improved fermentation lock apparatus of the type comprising a positive seal fermentation lock for a barrel having a bung hole, and having stopper member having a top surface, a bottom surface, and an outer circumferential surface for sealing against the inner circumferential surface of said barrel's bung hole, said stopper member including a central aperture having a length and a diameter, and a sealing insert member having a top portion, a middle portion, and a bottom portion, said top portion having a diameter greater than said stopper member central aperture diameter and further having an exterior circumferential surface, said top portion having a lower surface for sealing against said stopper member top surface, said middle portion having a length generally equal to said stopper member central aperture length, and a diameter less than said stopper member central aperture diameter, said bottom portion including two flexible lateral projection elements to contact and apply a force against said stopper member bottom surface, so as to urge said top portion lower surface into sealing engagement with said stopper member top surface, wherein when gases form inside the barrel, the resultant pressure will exert a force against said insert member top portion lower sealing surface, and flex said lateral projection elements, breaking the seal formed between said insert member top portion lower sealing surface and said stopper member top surface, allowing the gases to escape, wherein the improvement comprises:

means for creating a seal between the exterior circumferential surface of the top portion of the sealing insert member and the central aperture of the stopper member; and wherein said bottom surface of said stopper apparatus includes a recessed portion which accommodates said lateral projections of said sealing insert member.

2. The improved fermentation lock apparatus of claim 1, wherein said stopper member has a generally frusto-conical shape.

3. The improved fermentation lock apparatus of claim 1 wherein said means for creating a seal comprises a sealing insert member top portion lower surface which is frusto-conical in shape.

4. The improved fermentation lock apparatus of claim 1, wherein said means for creating a seal comprises a sealing insert member having top portion diameter between 0.05 and 0.15 inches greater than the diameter of the central aperture of said stopper member.

5. The improved fermentation lock apparatus of claim 1 wherein said stopper member includes a lower threaded portion for threadable insertion into a complementary threaded hole in a vessel.

6. The improved fermentation lock apparatus of claim 1, wherein said sealing insert member may be pushed down into the central aperture of said stopper member so as to form a positive seal so that said top surface of said sealing insert member is flush with said top surface of said stopper member.

7. An improved fermentation lock apparatus of the type comprising a positive seal fermentation lock for a barrel having a bung hole, and having stopper member having a top surface, a bottom surface, and an outer circumferential surface for sealing against the inner circumferential surface of said barrel's bung hole, said stopper member including a central aperture having a length and a diameter, and a sealing insert member having a top portion, a middle portion, and a bottom portion, said top portion having a diameter greater than said stopper member central aperture diameter and further having an exterior circumferential surface, said top portion having a lower surface for sealing against said stopper member top surface, said middle portion having a length generally equal to said stopper member central aperture length, and a diameter less than said stopper member central aperture diameter, said bottom portion including two flexible lateral projection elements to contact and apply a force against said stopper member bottom surface, so as to urge said top portion lower surface into sealing engagement with said stopper member top surface, wherein when gases form inside the barrel, the resultant pressure will exert a force against said insert member top portion lower sealing surface, and flex said lateral projection elements, breaking the seal formed between said insert member top portion lower sealing surface and said stopper member top surface, allowing the gases to escape, wherein the improvement comprises:

means for creating a seal between the exterior circumferential surface of the top portion of the sealing insert member and the central aperture of the stopper member; and wherein said stopper member includes a lower rim adapted for clamping onto the surface of a vessel.

8. The improved fermentation lock apparatus of claim 7 wherein said means for creating a seal comprises a sealing insert member top portion lower surface which is frustoconical in shape.

9. The improved fermentation lock apparatus of claim 7, wherein said means for creating a seal comprises a sealing insert member having top portion diameter between 0.05 and 0.15 inches greater than the diameter of the central aperture of said stopper member.

10. The improved fermentation lock apparatus of claim 7, wherein said sealing insert member may be pushed down into the central aperture of said stopper member so as to form a positive seal so that said top surface of said sealing insert member is flush with said top surface of said stopper member.

* * * * *